United States Patent [19]

Broadhurst

[11] Patent Number: 4,660,490

[45] Date of Patent: Apr. 28, 1987

[54] RECREATIONAL SEMI-DISPLACEMENT HULL WATERCRAFT

[75] Inventor: Daniel J. S. Broadhurst, Mastic Beach, N.Y.

[73] Assignee: Olympia Sports Products, Inc., Plainview, N.Y.

[21] Appl. No.: 824,073

[22] Filed: Jan. 30, 1986

[51] Int. Cl.[4] ..... B63B 1/16; B63B 35/71

[52] U.S. Cl. ..... 114/56; 114/347; 114/363

[58] Field of Search ..... 114/56, 347, 356, 357, 114/358, 355, 290, 291, 363; 441/65, 74; D12/300, 302, 313

[56] References Cited

U.S. PATENT DOCUMENTS 25,857 10/1859 Wells ..... 114/56

49,503 8/1916 Hartz ..... D12/300

FOREIGN PATENT DOCUMENTS 3143769 5/1983 Fed. Rep. of Germany ..... 441/74

3211887 10/1983 Fed. Rep. of Germany ..... 441/74

1187283 9/1959 France ..... 114/357

1485666 6/1967 France ..... 114/357

*Primary Examiner*—Sherman D. Basinger

*Attorney, Agent, or Firm*—Dimitrios T. Drivas

[57] ABSTRACT

A watercraft comprising an efficient, directionally stable and maneuverable hull construction useful for recreation and water sports. In a preferred embodiment the hull has an outwardly projecting flange longitudinally positioned along the periphery of the hull substantially about the waterline, whereby the flange increases the directional stability and maneuverability of the hull and keeps the wetted surface area of the hull to a minimum.

9 Claims, 8 Drawing Figures

RECREATIONAL SEMI-DISPLACEMENT HULL WATERCRAFT

BACKGROUND OF THE INVENTION

The invention relates to watercraft and more particularly to the construction of such sport and recreational watercraft as paddle propelled watercraft, surf kayaks, surf skis, surfboards, sail boards and rowing sculls.

The principle forms of resistance which have an effect on the travel of a hull through water are skin friction, wave making and eddy making. These forms of resistance are not constant and vary with the speed of the watercraft, the hull shape and the smoothness of the surface or skin of the hull.

The skin friction of the hull is caused by the tendency of water to stick to the sides of a moving hull and to be dragged along with it. The skin friction can be reduced by smoothing the surface of the hull i.e. by polishing or constructing the hull from a smooth surfaced material, and by streamlining or keeping any projections on the hull to a minimum. The skin friction of the hull can also be reduced by keeping the wetted surface area of the hull to a minimum.

The skin friction of the hull surface is greater at the bow than it is aft of the bow. Thus, the skin friction of a hull section is reduced proportionately as the section is located further aft from the bow. Accordingly, a longer hull is faster than a shorter wider hull of the same volumetric displacement, i.e. a racing scull is faster than a dinghy having the same volumetric displacement.

As a hull moves forward in the water it preempts space and pushes water out and down away from the hull. As the hull vacates the space water rushes back to fill the void, thus creating waves. Two kinds of waves are formed by the moving hull; bow waves which move diagonally away from the hull and side waves which move alongside the hull and eventually recombine at the stern to cause the disturbance known as the eddy. These waves do nothing to propel the hull, and have the effect of increasing the hull's resistance. The shape of the hull is a major factor in such wave formation.

The most critical factor in reducing hull resistance is the design. There are principally two forms of hull designs, the displacement hull and the planing hull. A displacement hull always displaces the same amount of water. Whether the displacement hull is at rest or in motion its waterline does not change. Thus to obtain a faster displacement hull one must increase its waterline length relative to its volumetric displacement. By contrast a planing hull gradually rises out of the water after it has attained a critical speed, thus reducing the wetted surface area of the hull. As the planing hull rises it displaces less and less water, and its total hull resistance drops and its speed increases.

Other hull design concepts are also used to reduce hull resistance. For instance the hull design concept of a double-ender watercraft, having a bow and stern of similar shape, e.g. a kayak, decreases hull resistance by decreasing the turbulence of recombining side waves of the stern and thus decreasing eddy formation.

The increased interest in recreation and sports involving watercraft such as, surf and whitewater kayaking, and windsurfing has renewed interest in the design and hull construction of small watercraft. The importance of hull design is illustrated by the evolution of cruising type sailboards. Sailboards hulls have evolved from flat bottom planing boards and surfboard type boards with a longitudinal rise or rocker to semi-displacement hull forms having a displacement type hull with an extreme amount of bow rocker. Since the power used to propel such small craft such as sailboards is limited, hull design becomes a significant factor in enhancing hull efficiency and stability. It is apparent, however, that there are many trade-offs involved in the design of such watercraft. The same features that are necessary for instance to enhance speed often detract from the maneuverability and stability of the craft. In addition hull designs for efficient for use at high speeds e.g. a planing hull, may not be efficient for use at lower cruising speeds, or maneuverable at such speeds. Various designs have been proposed for the design of more efficient hull forms for such craft, e.g. Weiss, U.S. Pat. No. 4,434,737 and Cashmere, U.S. Pat. No. 4,538,540; however, these designs do not appear to be useful for the wide range of sail and paddle powered recreational and sport watercraft.

The present invention concerns a novel watercraft design and hull construction which provides stable maneuverable watercraft with low hull resistance. This invention is useful in the design and construction of a wide range of watercraft types including muscle-powered and sail-powered watercraft.

SUMMARY OF THE INVENTION

The present invention provides a watercraft having a smooth surfaced hull and having a bow section, a middle section and a stern section. The hull has an outwardly projecting downwardly directed flange longitudinally positioned along the periphery of the hull substantially about the waterline dividing the hull into the bottom part and top part. The flange is progressively inclined downward from the bow to the middle section and from the stern to the middle section. The flange of the invention is positioned configured and dimensioned to cooperate with the surrounding water to take advantage of hydrodynamic forces affecting the watercraft and thus improve the directional stability and maneuverability while keeping the wetted surface area of the hull to a minimum.

In another embodiment of the invention the invention provides a watercraft having a smooth-surfaced, semi-displacement, double-ender hull having a top portion, a bottom portion, a bow section, a middle section and a stern section. The ratio of the length of the hull to its maximum beam is about 6:1 or greater, and the ratio of the maximum beam to the maximum depth of the hull is about 2.5:1 or greater.

In this embodiment the longitudinal profile of the semi-displacement hull shows a substantial rise in the keel line from the middle section to the bow and a smaller rise in the keel line from the middle section to the stern. The rise in the keel line from the middle section to the bow is preferably from about two to about four times the rise in the keel line from the middle section to the stern.

The transverse or cross-sectional profile of the semi-displacement hull has a substantially flat bottom in the middle section with convexity up to the top portion of the hull. The convexity of the hull bottom increases along the longitudinal axis of the hull from the middle section towards the bow and the stern.

The top portion of the semi-displacement hull has a substantially flat portion which serves as a deck and has a rolled down convex freeboard. The top portion also has a substantial upward slope from the middle section to the bow and a slight downward slope from the middle section to the stern.

The semi-displacement hulls of this invention are useful for the construction of a wide range of small watercraft and preferably paddle-powered and sail-powered watercraft. In a preferred embodiment of the invention the semi-displacement hull may also comprise a hull having the outwardly directed flange of the invention longitudinally positioned along the periphery of the hull substantially about the waterline. In other embodiments of the invention the hull may also have a cockpit intergrally formed with the top portion of the hull. The cockpit is located substantially about the middle section of the hull and is contoured and designed to accommodate occupants of different sizes. The semi-displacement hulls may optionally have a fin or fins located on the bottom portion of the hull in the stern section.

DETAILED DESCRIPTION OF THE INVENTION

The present invention provides a watercraft comprising a hull having a bow section, a middle section and a stern section, the hull having an outwardly projecting flange longitudinally positioned along the periphery of the hull substantially about the waterline. FIG. 6 depicts a detailed view of the flange 20, positioned longitudinally along the periphery of the middle section of the hull substantially about the waterline, line W. The flange divides the hull into a bottom part 18, and a top or deck part 16, as shown in the preferred embodiment depicted in FIGS. 1, 3, 4, 5, 7 and 8.

Figure 2:
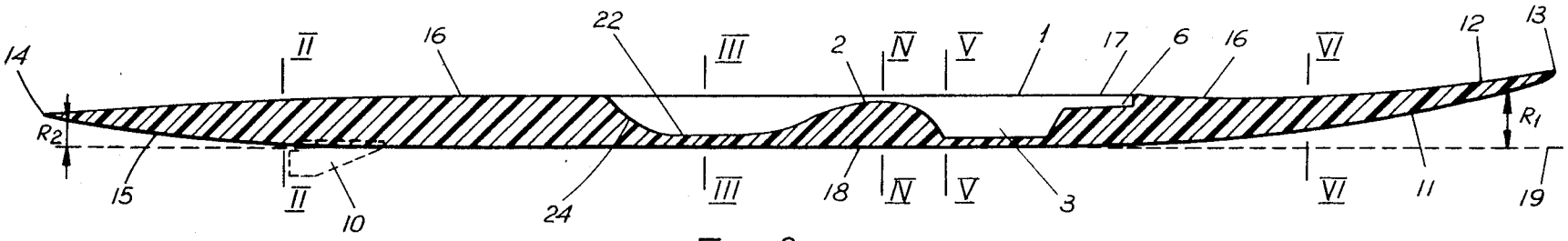
FIG. 2 is a longitudinal sectional view of the watercraft depicted in FIG. 1.
Figure 5:
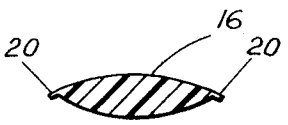
FIG. 5 is a cross-section of the bow section of the watercraft depicted in FIG. 2, line VI.
Figure 6:
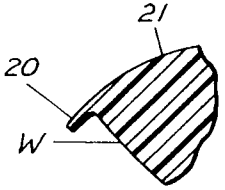
FIG. 6 is a detailed view of FIG. 4, I, showing the outwardly projecting flange of the invention.
Figure 3:
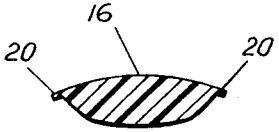
FIG. 3 is a cross-section of the stern section of the watercraft depicted in FIG. 2, line II.

The flange is also progressively inclined downward from the bow section, FIG. 5, and the stern section, FIG. 3, towards the middle section, FIGS. 4, 6, 7 and 8. In a preferred embodiment of the invention the flange is outwardly projecting and downwardly directed throughout the periphery of the hull. In the bow section and specifically towards the tip of the bow 13, as depicted in the preferred embodiment of FIG. 2 the flange is only slightly inclined downward. The downward inclination of the flange in the stern section and particularly towards the stern 14, is also slight but is usually more downwardly directed than the flange in the bow section periphery. In other embodiments of the invention the flange in the bow and stern sections may be projecting horizontally from the periphery of the hull or may be slightly upturned. The flange is progressively inclined downward from the stern and bow towards the middle section of the hull were it maintains an angle of downward inclination substantially as depicted in FIG. 6. It is preferred that the angle of the downward inclination of the flange along the periphery of the middle section of the hull is substantially constant.

As depicted in FIG. 6 the flange 20, of this invention is positioned substantially about the waterline, line W, so as to cooperate with the surrounding water and the hydrodynamic forces acting on the hull. The flange keeps the wetted surface area of the hull to a minimum and thus reduces the total hull resistance. The flange is also positioned configured and dimensioned to increase the stability of the hull and the maneuverability of the craft.

The position of the flange along the periphery of the hull is such that when the watercraft is occupied by an operator the flange is in close proximity with the surface of the water as shown in FIG. 6. The flange may contact the water along some of the points on the periphery of the hull, however, it should be positioned so that the flange is never substantially below the waterline as measured in still water.

It is preferred that when the watercraft is occupied the flange is in close proximity with the waterline (determined in a still body of water), along the majority of the hull's periphery. The extent to which the flange is in close proximity with the surface of the water along the periphery may vary with other design features of the hull. For example a hull with an extreme amount of bow rocker or stern rocker may have areas in its bow or stern section where the flange is not in close proximity with the waterline.

The peripheral flange must be positioned along the majority of the periphery of the hull at a suitable distance from the waterline so that it can cooperate with the surrounding water to impart directional stability to the hull, increase the hull's maneuverability and keep the wetted surface area of the hull to a minimum. As discussed previously the position of the flange on the periphery of the hull may vary with respect to the waterline in accordance with other design features of the hull. The position of the flange may also vary with the intended use and purpose of the watercraft, e.g. a paddle-powered craft intended for use in bodies of water where the surface is relatively flat may need a flange positioned closer to the waterline as measured in a still body of water than a watercraft intended for use in surfing rolling swells or river whitewater. In light of this concept it follows that the suitable distance of the flange from the waterline (measured in still water) will vary with the type of craft, its intended use, and the relative position of the flange on the hull, i.e. stern section, middle section or bow section.

Generally the position of the flange along the periphery of the middle section of a watercraft containing an average occupant may range from a position where the edge of the flange is contiguous with the waterline to a position where the edge of the flange is no more than about three (3) inches above the waterline when measured in still water.

The length of the flange projecting from the periphery of the hull may vary with the width of the hull and along the length of the hull. In preferred embodiments of the invention the total projecting length of the flange is expressed in terms of a ratio to the cross-sectional width of the hull. For example in a hull whose maximum cross-sectional width from the edge of the starboard side flange to the edge of port side flange is 25 inches, the ratio of the flange length to the cross-sectional width may be about 1:25. In this example therefore the flange is projecting out one half inch (0.5) on either side of the hull. The flange of a preferred embodiment of the invention as depicted in FIG. 6 typically projects out at a length from about 0.5 to about 3.0 inches. The ratio of flange length to maximum cross-sectional width in this embodiment is from about 1:25 to about 6:30. The ratio of the flange projecting length to cross-sectional width along the periphery of other sections of the hull may also vary, e.g. having a higher ratio at the bow or stern. Alternatively the ratio may remain in a constant proportional relationship along the periphery of the hull.

The peripheral flange of this invention enhances the efficiency of the hull by cooperating with the hydrodynamic forces acting on the hull as it moves through the water. One way, in which the flange enhances the efficiency of the hull is by keeping the wetted surface area of the hull to a minimum. The peripheral flange has this effect by primarily acting as a water shedding device. The outwardly projecting and downwardly directed flange deflects water away from the top portion of the hull and thus reduces the skin friction by minimizing the wetted surface area of the hull. The flange also prevents bow waves and side waves created by the hull's forward movement in the water from climbing the sides of the hull. As the bow waves and side waves are deflected by the underside of the flange a force may be directed upwards against the underside of the flange. This upward force may act to lift the watercraft out of the water into a planing position thus decreasing the wetted surface area of the hull. The flange may also act to slow the diagonal and longitudinal waves caused by the hulls displacement to reduce the turbulence below the hull. The flange may also act to deflect a portion of the bow and side waves created by the hulls forward motion towards the hull bottom. The deflected water may then form a layer of water close to the skin of the hull which reduces the turbulence of the water flowing below the hull, thus reducing drag and increasing efficiency. The use of the peripheral flange on a hull allows for such a hull to obtain a greater speed per energy input as compared to a non-flanged hull of the same design and dimensions.

The peripheral flange also contributes directional stability and maneuverability to the hull. In a narrow-beamed semi-displacement or displacement hull watercraft having either a flat bottom with slight convexity, or a round bottom, the flange acts to impart a greater degree of lateral resistance to the hull thus increasing its directional stability. The flange also prevents excessive roll of such hulls and helps to prevent the watercraft from capsizing. As the watercraft rolls the flange along one side of the hull enters the water. The immersed flange may operate as a fin or keel and thus enhance the maneuverability of the watercraft.

The peripheral flange's contribution to stability and maneuverability of the watercraft is particularly evident when the flange is positioned on the hull of watercraft used for surfing or whitewater river travel, e.g. surfboards, sailboards, surf skis, ocean kayaks, kayaks and canoes. On such craft the peripheral flange acts as a claw rail. The claw rail hangs on the curved water surface of the rolling swell or wave increasing the frictional resistance of the hull in the lateral direction. Watercraft comprising the peripheral flange of this invention are thus more stable and maneuverable under ocean surf and whitewater conditions and may even be used without a dorsal fin.

Generally the total resistance of the hull decreases as the length to beam ration increases. However as the length to beam ratio increases the stability of the hull decreases. Even though the peripheral flange of this invention is useful in the construction of small watercraft of all sizes, e.g. length to beam ratio of 3:1, it is particularly useful in craft of higher length to beam ratios. The use of the peripheral flange of this invention may tend to stabilize the hulls of such longer craft. In certain embodiments of the invention the length of the hull is at least five times the maximum beam and preferably at least six times the maximum beam. The maximum beam of the hull is defined as the maximum cross-sectional width of the hull. In measuring the maximum beam the projecting length of the peripheral flange is not measured. The hulls of this invention having a 5:1 length to beam ratio or a greater length to beam ratio are useful for surf skis, sailboards, surf kayaks, recreational sculls and other similar types of sport and recreational watercraft.

The peripheral flange of this invention is particularly useful in the construction of semi-displacement type hulls. Such hulls usually have a minimal amount of volumetric displacement. Such hulls are also characterized by a minimal hull depth and generally have an extreme amount of bow rocker. The semi-displacement hulls of this invention are generally characterized by a ratio of the maximum beam of the hull to the maximum depth of the hull of 2.5:1 or greater. The semi-displacement type hulls of this invention are particularly useful for recreational and sport watercraft intended for use in surf, whitewater and open sea, e.g. surf skis, sailboards and kayaks.

These semi-displacement type hulls can be rendered more maneuverable by constructing the hull with a bow rocker and a stern rocker. Rocker is a term which defines the longitudinal rise in the profile of the hull. The incorporation of a bow rocker allows the craft to penetrate and break waves satisfactorily. The bow rocker and the stern rocker also allow the craft to be manipulated and maneuvered more easily in flat water, surf or ocean swell and whitewater conditions.

In certain embodiments of the invention the semi-displacement hulls have a substantial rise in the keel line 19, FIG. 2, from the middle section to the bow and a smaller rise in the keel line from the middle section to the stern. The keel line is defined as the central bottom extremity line of the hull. In other embodiments of the invention the rise in the keel line in the stern may be about equal to the rise in the keel line in the bow, e.g. a highly maneuverable craft for use in whitewater. In a specific embodiment of the invention the rise in the keel line from the middle section to the bow, e.g. $R_1$, FIG. 2 is from about two to about four times the rise in the keel line from the middle section to the stern, e.g. $R_2$, FIG. 2. The ratio of the rise in the keel line from the middle section to the bow (bow rocker) to the rise in the keel line from the middle section to the stern (stern rocker) may therefore vary with the intended use of the watercraft. For instance, where the craft will be used to surf high waves it is preferable that the bow rocker be greater than the stern rocker so that it is easier for the occupant to surf on the face of the wave. On the other hand, where the craft is intended for use in turbulent whitewater it may be preferable that the craft have a lower bow rocker and a higher stern rocker so that the craft is more maneuverable thus allowing the occupant to make fast turns.

In a preferred embodiment of the invention the flange also serves as an overlap seam for the joining of the top portion and bottom portion of the hull. This method of construction is useful for constructing the hull out of various materials e.g. aluminum, fiberglass. It is preferred that the portions of the hull are intergrally molded laminated plastic, and are joined in a water tight seal along the flange. This method of construction is more economical and efficient. The use of a flange along the periphery of a hull also contributes to the structural strength of the hull.

Figure 1:
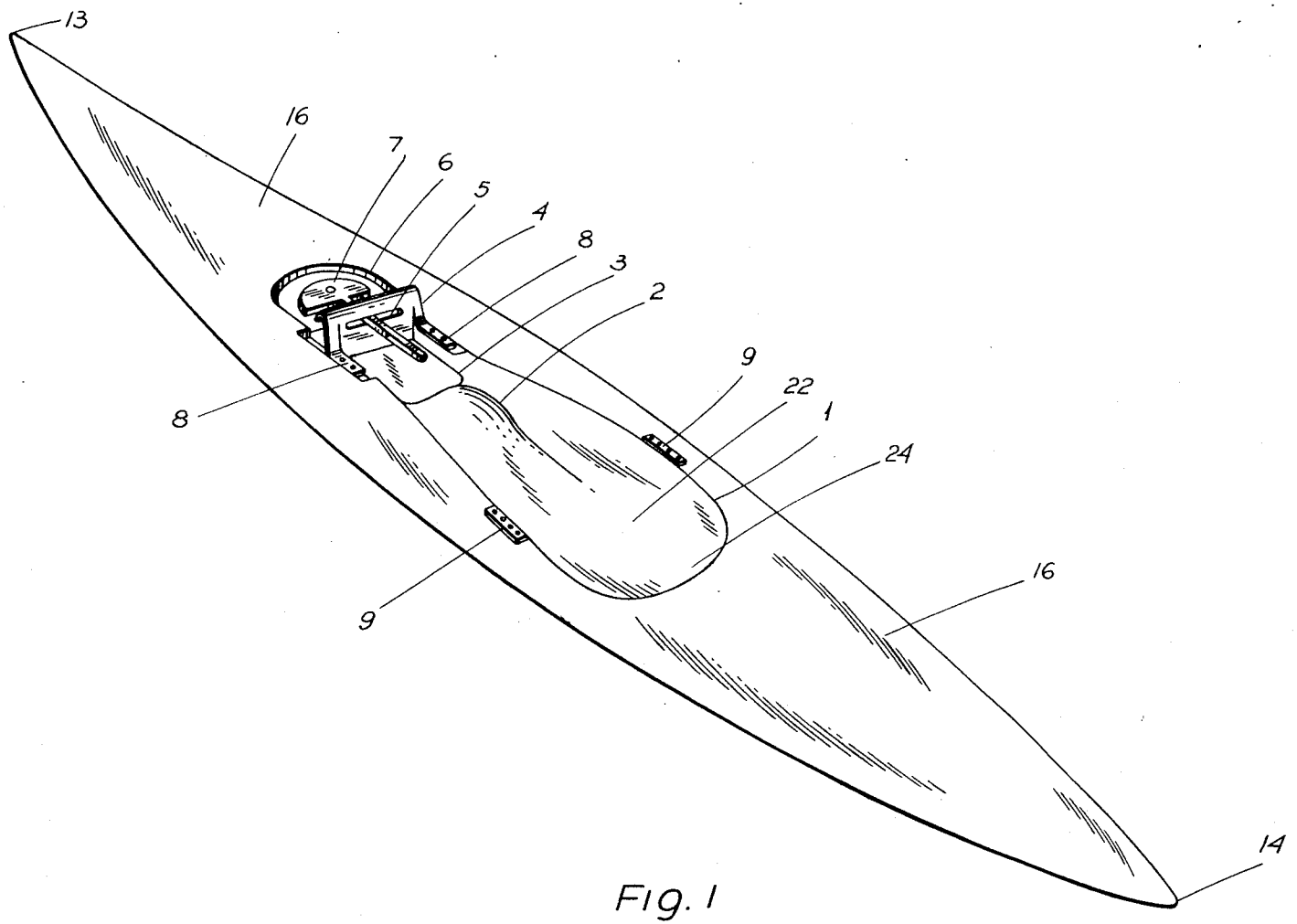
FIG. 1 is a perspective view of a paddle powered watercraft according to the present invention.

The present invention also concerns a watercraft comprising a smooth surfaced, semi-displacement, double-ender hull having a bottom portion, a top portion, a bow section, a middle section and a stern section. FIG. 1 is a perspective view and FIG. 2 is a longitudinal sectional view of this embodiment of the invention. The ratio of the length of the hull to its maximum beam is about 5:1 or greater, and the ratio of the maximum beam to the maximum depth of the hull is about 2.5:1 or greater. In a specific embodiment of the invention the watercraft is about 14 feet 6 inches in length having a maximum beam of about 24 inches. The maximum depth of the hull is about 6.5 inches. The middle section of the hull is a section generally located from a position about 25 to 30 percent of the length aft of the bow to a position about 70 to 75 percent of the length aft of the bow.

The longitudinal profile of the hull, FIG. 2 has a substantial rise, in the keel line, 19, from the middle section to the bow, 13, and a smaller rise in the keel line from the middle section to the stern, 14. The rise in the keel line from the middle section to the bow is depicted as $R_1$ and the rise in the keel line from the middle section to the stern is depicted as $R_2$. In a preferred embodiment the rise in the keel line from the middle section to the bow, $R_1$ is from about two to about four times the rise in the keel line from the middle section to the stern, $R_2$.

The rise in the keel line from the middle section of the hull to the bow defines the bow rocker of the hull. In a preferred embodiment of the invention such as that depicted in FIG. 2 this bow rocker is substantial, e.g. the tip of the bow may be positioned from about 6 to 12 inches from the keel line. This rocker allows the watercraft to penetrate or break waves and surf and allows the craft to be maneuvered easily in water.

The rise in the keel line from the middle section to the stern defines the stern rocker. In the preferred embodiment of FIG. 2 the tip of the stern may be positioned from about 0.5 to about 8 inches above the keel line, and is preferably from about 2 to about 6 inches above the keel line.

Figure 4:
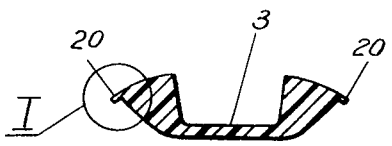
FIG. 4 is a cross-section of the heel well in the middle section of the watercraft depicted in FIG. 2, line V.
Figure 8:
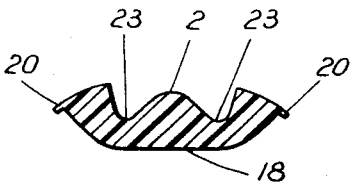
FIG. 8 is a cross-section of the contoured leg support in the middle section of the craft depicted in FIG. 2, line IV.
Figure 7:
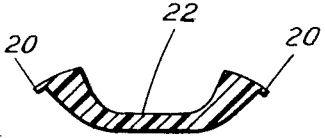
FIG. 7 is a cross-section of the seat pan in the middle section of the craft depicted in FIG. 2, line III.

The transverse profile of the hull has a substantially flat bottom 18, with convexity up to the top portion FIGS. 4, 7 and 8. The term substantially flat bottom is meant to encompass embodiments of the invention wherein there is a slight rise in the cross-sectional profile from the keel line to the point of convexity or angle to the freeboard, e.g. a cross-sectional rise from about 0.1 to about 1 inches. The convexity of the bottom increases along the longitudinal axis of the hull from the middle section FIG. 4, 7 and 8 to the bow, FIG. 5 and stern FIG. 3. In a preferred embodiment having a hull length of about 14 feet 6 inches, the area of the bottom portion of the hull from about 4 feet 6 inches aft of the bow to about 12 feet aft of the bow is flat with a slight convexity. This convexity is defined by an angled freeboard of about 45° from the waterline to the gunwhale.

The top portion of the hull, FIGS. 1 and 2 has a substantially flat deck 16, and a rolled down convex freeboard 21, FIG. 6. The convex freeboard or area between the flat deck and the waterline serves as a watershedding feature. In conjunction with the flat deck this feature also decreases the resistance of the hull to wind. The flat deck preferably does not have any projections that can break the skin. It may however have various cleats and hold down attachment points for securing articles to the deck. The deck of the top portion of the hull has a substantial upward slope 12, from the middle section to the bow and a slight downward slope from the middle section to the stern 14. In other embodiments of the invention the deck of the stern section or the bow section may be in a horizontal plane with the deck of the middle section.

In a preferred embodiment of the invention the deck of the watercraft has as a depression therein a cockpit 1, FIGS. 1 and 2, capable of accommodating occupants of different sizes, e.g. 4'10" and 90 pounds to 6'5" and 240 pounds. The cockpit is intergrally formed with the deck or top part of the hull and has a lower forwardly positioned first floor 3, and a slightly higher rearwardly positioned second floor 22, separated by an upwardly projecting contoured leg support 2.

The first floor is substantially flat and constructed to serve as the base of a heel well for receiving the feet of the occupant of the watercraft, shown in a cross-sectional view in FIG. 4. The heel well is provided with an adjustable foot rest means 4, mounted for sliding translation along the length of the heel well and is also provided with a fastening means 8, for removably securing the foot rest in the heel well.

In a specific embodiment of the invention the foot rest has a slot 5, for receiving the radius bar of a tiller 7, located in a tiller pan indentation 6, positioned forwardly of the heel well and being intergrally formed therewith. By moving the tiller bar with his or her feet the occupant can control a rudder attached to the stern of the craft and connected to the tiller by means of a cable.

The contoured leg support 2, shown in a cross-sectional view in FIG. 8, extends and slopes upwardly from the first floor 3, and has a central projection 2, configured and positioned so as to form two symmetrical concave channels 23, contoured to accommodate the legs of the occupant. The rearward portion of the leg support sloping downwardly towards and gradually changing in shape to become co-extensive with the second floor 22. In addition to serving as a leg brace the upwardly projecting leg support reduces the void volume of the cockpit that could fill with water.

The second floor 22, defines the base of a seat pan, shown in a cross-sectional view in FIG. 7, having a substantially concave U-shaped cross-section. The second floor gradually slopes downward from its forward portion co-extensive with the leg support means 2, to a point of maximum depth and then gradually slopes upwards with concavity to form the rear wall of the pan 24. The lowest point of the second floor is positioned at a level above that of the lowest point of the first floor. In a specific embodiment of the invention the level of the second floor is about one inch higher than the level of the first floor. This places the occupant or paddler in a more comfortable and efficient or dominant paddling postion.

The width of the seat pan gradually increases from the front of the pan to a point of maximum width and thereafter decreases and becomes co-extensive with the substantially concave rear wall 24. The ratio of the maximum width of the seat pan to the maximum depth of the seat pan is about 4:1 or greater. This ratio allows for a seat pan wherein the occupants buttocks are located in a position within the indentation and substantially below the deck level. The occupant can thereby bring his or her body into contact with the side wall of the indentation. By swiveling the hips the occupant can thereby impart a lateral force upon the watercraft.

In a specific embodiment of the invention the top portion of the hull also has means 9, adjacent to the side walls of the seat pan for attaching a seat belt.

In a preferred embodiment of the invention the cockpit indentation is located on the top part of the hull at a position substantially within the middle section of the hull. The cockpit is usually located within an area that is from about 25 to 30 percent of the length aft of the bow to about 60 to 65 percent of the length aft of the bow.

In the specific embodiment of the invention wherein the craft is about 14.5 feet in length, the most forward part of the cockpit indentation is positioned at about 4 feet aft of the bow and the rear wall of the seat pan is about 9 feet aft of the bow. In a preferred embodiment of the invention the ratio of the length of the seat pan to the length of the heel well is from about 2.0:1 to about 3.0:1 and preferably about 2.6:1. The ratio of the maximum width of the seat pan to the minimum width of the seat pan is from about 1.25:1 to about 1.35:1 and preferably about 1.28:1. The minimum width of the seat pan is located at the position where the second floor becomes co-extensive with the contoured leg support. The maximum width of the seat pan is located at a position from about 70 to about 75 percent of the length aft of the position of minimum width.

In a preferred embodiment of the invention wherein the hull has a maximum depth in the middle section from about 6 to about 8 inches and a total hull length from about 12 to about 18 feet, the length of the contoured cockpit from the most forward part of the heel well to the rear wall of the seat pan is from about 50 to about 60 inches and preferably about 54 inches. The length of the heel well from its forward wall to the point were it becomes co-extensive with the contoured leg support is from about 12 to about 16 inches and preferably about 14 inches. The width of the heel well is from about 8 to about 12 inches and preferably about 11 inches. The depth from the deck to the first floor is from about 4.5 to about 5 inches and preferably about 4.9 inches. The length of the contoured leg support from the point where it is co-extensive with the first floor to the point where it is co-extensive with the second floor is from about 8 to about 22 inches and preferably about 15 inches as measured along the keel line. The length from the first floor to the peak of the upward projection is from about 4 to about 8 inches and preferably about 6 inches. The upward projection of the leg support generally projects up to a point from about 3 to about 5 inches from the first floor and preferably about 3.3 inches. The upward projection preferably does not project beyond the level of the deck. In a specific embodiment of the invention the uppermost projection of the leg support is about 1.6 inches below the level of the deck. The length of seat pan from the point where the second floor is co-extensive with the leg support to its rear wall is from about 20 to about 36 inches and preferably about 27 inches. The minimum width of the seat pan is from about 10 inches to about 14 inches and preferably about 12.5 inches. The maximum width of the seat pan is from about 14 inches to about 20 inches and preferably about 16 inches. The maximum depth of the seat pan as measured from the deck level to the second floor is from about 3 to about 4 inches. The second floor is always positioned at a level from about 0.5 to about 1.5 inches and preferably about 1 inch higher than the level of the first floor. The maximum depth of the seat pan is usually located substantially about the position of the maximum width of the seat pan.

The watercraft of this invention may also have a fin 10, FIG. 2 positioned on the bottom part of the hull in the stern section. The fin is preferably located at a position from about 75 to 85 percent of the length of the hull aft of the bow. In a preferred embodiment of the invention having a hull of about 14.5 feet in length the fin is located at a postion from about 11 to about 12 feet aft of the bow. The fin may be intergrally formed with the bottom part of the hull, however, it is preferable that the fin be removable. In this preferred embodiment a means for attaching the fin e.g. an indented fin box, is attached to the hull and the fin is removably secured therein.

In a preferred embodiment of the invention the hull of the watercraft also comprises an outwardly projecting downwardly directed flange longitudinally positioned along the periphery of the hull substantially about the water line. This flange is positioned, configured and dimensioned to increase the directional stability and maneuverability of the watercraft and to keep the wetted surface area of the hull to a minimum. The flange acts as a wave deflector and may assist in the planing of the hull. This embodiment having the peripheral flange may also optionally have a fin positioned in the bottom stern section of the hull.

The watercraft of this invention can be constructed by any method known to those of ordinary skill in the art. For example the watercraft may be made of wood, aluminum, fiberglass, laminated plastic shells or shells made of composites e.g. fiberglass/nylon, or fiberglass-/kevlar. The shells may be hollow or may contain vertical or longitudinal stringers or some other form of internal structure or framework. Alternatively the hull may be foam filled. In other embodiments the craft may be constructed entirely of foam having a soft inner core and a hard dense water and oil resistant foam outer skin. The watercraft may be injection molded, rotationally molded or blow molded. These moldings may be either solid or over foam. Generally any construction method utilizing an oil or water resistant skin over a thermoformed foam core may be used to construct the watercraft of this invention.

In a preferred embodiment of the invention wherein the hull has an outwardly directed peripheral flange the hull is constructed from a top and bottom portion made of a plastic or fiberglass laminate. The top and bottom portions are joined along the peripheral flange with a watertight seal. The interior of the hull in this embodiment comprises a thermoformed foam core. The foam core makes the hull more buoyant and virtually unsinkable.

Although the invention has been described with reference to particular illustrative embodiments, numerous modifications additions and other changes can be made to the present invention without departing from the scope and spirit thereof. Any such changes are meant to be within the scope of the invention as set forth in the claims.

I claim:

1. A watercraft comprising a smooth surfaced semi-displacement hull having a bow section, a middle section and a stern section, the hull having an outwardly projecting flange longitudinally positioned along the periphery of the hull substantially about the water line and dividing the hull into a bottom part and a top part, the flange being progressively inclined downward from the bow to the middle section and from the stern to the middle section, whereby the flange is positioned configured and dimensioned to increase the directional stability and maneuverability of the watercraft and to keep the wetted surface area of the hull to a minimum, the transverse profile of the hull in the middle section having a substantially flat bottom with convexity up to the top portion.

2. A watercraft as in claim 1 wherein the length of the hull is at least five times its maximum beam.

3. A watercraft as in claim 1 wherein the longitudinal profile of the hull has a substantial rise in the keel line from the middle section to the bow and a smaller rise in the keel line from the middle section to the stern.

4. A watercraft as in claim 1, wherein the ratio of the maximum beam of the hull to the maximum depth of the hull is about 2.5:1 or greater.

5. A watercraft comprising a smooth surfaced, semi-displacement, double-ender hull having a bottom portion, a top portion, a bow section, a middle section and a stern section, the top portion of the hull having a substantially flat deck and a rolled down convex freeboard, the deck having as a depression therein a cockpit capable of accommodating occupants of different sizes, the cockpit being integrally formed therewith and having a lower forwardly positioned first floor and a slightly higher positioned second floor separated by an upwardly projecting contoured leg support;

the first floor being substantially flat and constructed to serve as the base of a heel well for receiving the feet of the occupant of the watercraft, the heel well being provided with an adjustable foot rest means mounted for sliding translation along the length of the heel well and also being provided with a fastening means for removably securing the foot rest in the heel well;

the contoured leg support extending and sloping upwardly from the first floor and having a central projection configured and positioned so as to form two symmetrical concave channels contoured to accommodate the legs of the occupant, the rearward portion of the leg support sloping downwardly towards and gradually changing in shape to become co-extensive with the second floor;

the second floor defining the base of a seat pan having a substantially concave U-shaped cross-section, the second floor gradually sloping downward from its forward portion co-extensive with the leg support means to a point of maximum depth and then gradually sloping upwards with concavity and forming the rear wall of the pan, the lowest point of the second floor being positioned at a level above that of the lowest point of the first floor, the width of the seat pan gradually increasing from the front of the pan to a point of maximum width and thereafter decreasing and being co-extensive with the substantially concave rear wall, the ratio of the maximum width of the seat pan to the maximum depth of the seat pan being about 4:1 or greater.

6. A watercraft as in claim 5 wherein the hull also comprises an outwardly projecting downwardly directed flange longitudinally positioned along the periphery of the hull substantially about the water line and dividing the hull into a bottom part and a top part, the flange being progressively inclined downward from the bow to the middle section and from the stern to the middle section.

7. A watercraft as in claim 5 wherein the depression also has an indentation forwardly of and at a level above the first floor for receiving a tiller and wherein the adjustable foot rest has a slot positioned and configured to receive a radial bar of the tiller.

8. A watercraft as in claim 5, wherein the ratio of the length of the hull to its maximum beam is about 5:1 or greater, the ratio of the maximum beam to the maximum depth of the hull is about 2.5:1 or greater;

the longitudinal profile of the hull having a substantial rise in the keel line from the middle section to the bow and a smaller rise in the keel line from the middle section to the stern, wherein the rise in the keel line from the middle section to the bow is from about two to about four times the rise in the keel line from the middle section to the stern;

the transverse profile of the hull having a substantially flat bottom with convexity up to the top portion, the convexity increasing along the longitudinal axis of the hull from the middle section to the bow and stern;

the top portion of the hull having a substantial upward slope from the middle section to the bow and a slight downward slope from the middle section to the stern.

9. A watercraft as in claim 5 which also comprises a fin.

* * * * *